United States Patent [19]

Mayerjak

[11] 4,329,903

[45] May 18, 1982

[54] BACK FRAME FOR A PIANO OR THE LIKE

[75] Inventor: Robert J. Mayerjak, Torrington, Conn.

[73] Assignee: Currier Piano Company, Inc., Marion, N.C.

[21] Appl. No.: 80,181

[22] Filed: Oct. 1, 1979

[51] Int. Cl.[3] ..... G10C 3/04

[52] U.S. Cl. ..... 84/186 R

[58] Field of Search ..... 84/184–187, 84/193, 174, 177

[56] References Cited

U.S. PATENT DOCUMENTS

| | | | |
|---|---|---|---|
| 802,568 | 10/1905 | Huner | 84/186 |
| 885,247 | 4/1908 | Hasbrouck | 84/186 |
| 1,013,604 | 1/1912 | Lechner | 84/185 |
| 3,477,330 | 11/1969 | Bert | 84/193 |

*Primary Examiner*—Lawrence R. Franklin

*Attorney, Agent, or Firm*—McCormick, Paulding & Huber

[57] ABSTRACT

A back frame for a piano or like instrument is comprised by a laminated composite structure having outer laminates of sheet steel and an intermediate laminate which is formed by a reconstituted wood product. The steel laminates are joined to the intermediate laminate and the intermediate laminate is substantially thicker than the sheet steel to offset the outer laminates from one another and increase the stiffness of the structure. A plurality of integral beam elements extend through the laminated structure in the same general direction as the tensioning load of the strings in the piano, and the elements are spaced from one another and define openings in the frame through which sound is emitted from the sounding board of the instrument.

15 Claims, 8 Drawing Figures

BACK FRAME FOR A PIANO OR THE LIKE

BACKGROUND OF THE INVENTION

The present invention relates to pianos, harpsichords and like instruments in which a plurality of tensioned springs are struck or plucked to produce musical sounds. More particularly, the present invention relates to a back frame which holds the strings in tension in the musical instrument.

In both grand pianos and upright pianos there is a large frame assembly which supports the strings adjacent the hammers and holds the strings in tension over a bridge or bridges on the sounding board. The assembly traditionally includes a large metal plate defining a framework over which the strings are stretched from one side to the other, a wrest plank with a plurality of rotatable tuning pins mounted in the plank and projecting through the plate and a wooden frame connected with the wrest plank and the plate and reinforcing the plate against the large tensioning load of the strings. The sounding board is generally positioned between the plate and the wooden frame with the strings stretched over the board-mounted bridges.

The wooden frame is referred to hereinafter as the back frame. The term "back" in the case of an upright piano refers to the rear of the piano opposite from the keyboard at the front, and in the case of a grand piano or harpsichord, the back refers to the area behind or below the sounding board at the bottom side of the case.

The back frame traditionally includes a plurality of beams which extend from one side of the frame to the other in a direction generally parallel to the tensioning load of the strings and which are subjected to a bending moment due to the tensioning load. The beams are massive hardwood posts that in upright pianos or consoles may be three or four feet in length and have cross-sections of 3 inches by 2 inches.

The hardwood posts of such size are only a few of the many pieces which must be assembled and glued together, sometimes with additional bolts, to form the back frame, and because of the size of the frames and the fact that they must be made from a durable hardwood such as oak, they are relatively expensive and increase the cost of the instrument. The wood is also sensitive to moisture which may cause distortion and change the pitch of the tensioned strings, and the glued joints between the assembled pieces of the frame may weakened and fail with age and repeated exposure to moisture.

It is accordingly a general object of the present invention to provide an improved back frame for a piano or like instrument which can be manufactured from materials that are readily available and at lower cost. It is an object to the invention to provide a back frame having a laminated, composite structure with high stiffness or resistance to creep and distortion and the reliability inherent in an integrated design.

SUMMARY OF THE INVENTION

The present invention resides in a frame assembly for a piano, harpsichord or like musical instrument having a back frame which supports a plurality of strings in tension.

The back frame is comprised by a laminated composite structure having a geometric form corresponding to the back of the instrument such as the rectangular form of an upright piano or the angular and curved form of a grand piano or harpsichord. The laminated structure may have openings through the structure between generally parallel front and rear surfaces to permit sound to be emitted from within the case of the instrument. A plurality of integral beams may extend between one side and another of the geometric form and separate the openings provided for sound.

The laminated structure includes an outer rear laminate of metal which defines the rear surface of the structure and, a base laminate joined to the rear metal laminate and holding the metal laminate in spaced relationship from a string plate of the instrument. By maintaining a spaced relationship between the metal laminate and the plate, the laminated structure not only supports the plate under string load but also adds stiffness to the back frame due to the high Young's modulus of the metal. In one embodiment, an additional metal laminate is added to the front surface of the beams. With metal laminates on both the front and rear surfaces of the beams, the stiffness of the laminated structure is further improved.

The laminated composite structure eliminates the large hardwood posts and other separate pieces of the prior art back frames and can be manufactured more economically. The stiffness of the structure is more readily controlled with the metal and base laminates and the resulting structure is totally integrated as a single unit. The metal laminates are insensitive to moisture and cover a large portion of the surface area of the frame to resist moisture penetration into the base laminate. As a unitary structure with moisture-resisting features, the back frame provides a long life of reliable service.

DESCRIPTION OF THE PREFERRED EMBODIMENTS

Figure 1:
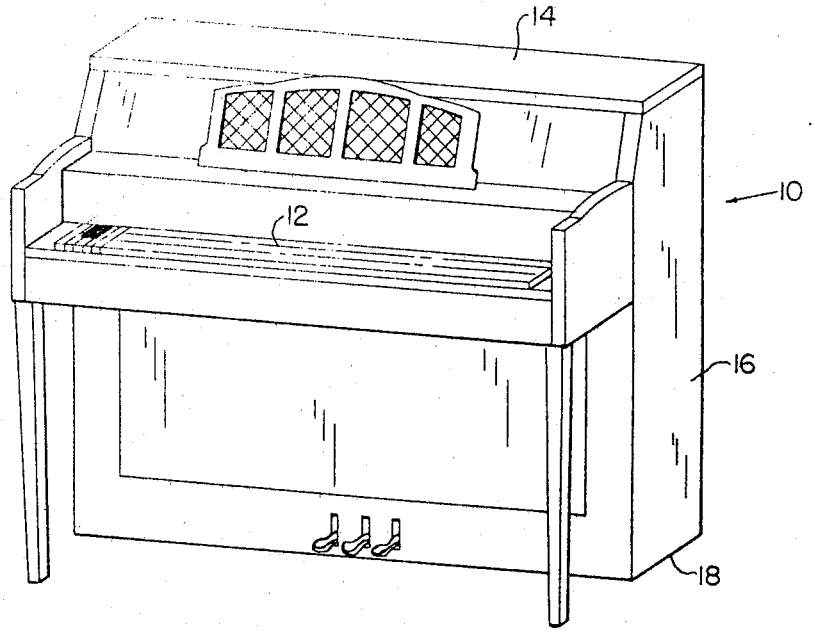
FIG. 1 is a perspective view of a piano in which the novel back frame of the present invention may be incorporated.

FIG. 1 illustrates a piano in which the novel back frame of the present invention may be utilized. The piano, generally designated 10, is an upright piano and has a keyboard 12 located at the front and the back frame which is not visible at the rear. However, the invention is not limited to upright pianos but is applicable to grand pianos, harpsichords and similar instruments in which a plurality of tensioned strings are struck or plucked to produce musical sounds. In the embodiment of the invention described hereinafter, the back frame has a rectangular shape corresponding to the back of the upright piano defined by the top 14, sides 16 and a bottom 18. In the grand pianos, and similarly in harpsichords, the back frame has an angular and rounded shape corresponding to the grand-piano profile and the frame is located at the bottom side of the piano behind the sounding board.

Figure 2:
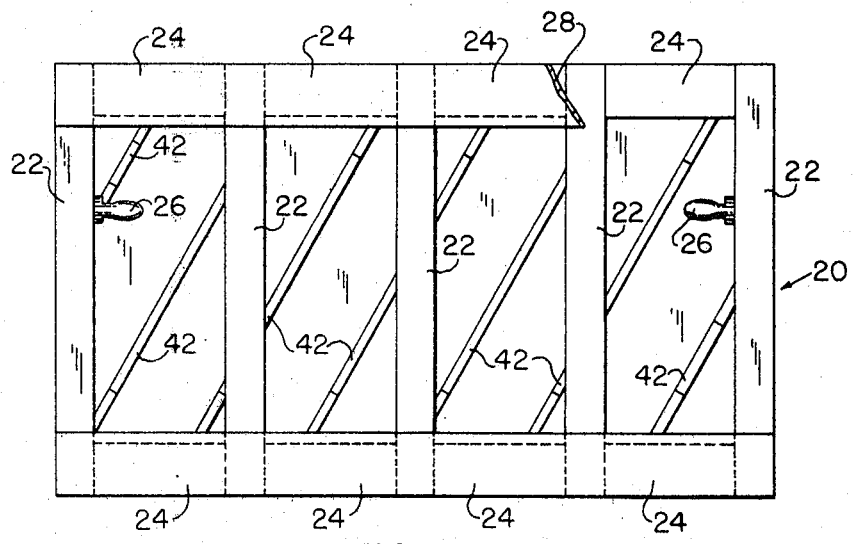
FIG. 2 PRIOR ART
FIG. 2 is a rear view of a piano such as shown in FIG. 1 and shows a back frame constructed in accordance with the prior art teachings.

FIG. 2 shows the rear of the piano shown in FIG. 1 with the traditional back frame 20 constructed in accordance with the teachings of the prior art. The frame 20 consists of five hardwood posts 22 that extend from top to bottom of the rectangular shape and a plurality of spacing blocks 24 separating the posts at top and bottom, and caps 28 that overlay the posts and blocks. The right side of the upper cap 28 is shown removed in FIG. 2 in order to clearly indicate its position. The posts are made from hardwoods such as oak, maple or sycamore and are substantial pieces of wood with large cross-sections. The spacing blocks are of similar woods and have similar cross-sections. The caps are relatively thin strips of wood typically plywood. All of the members of the frame are glued and sometimes bolted together to define the frame at the rear of the piano.

Figure 6:
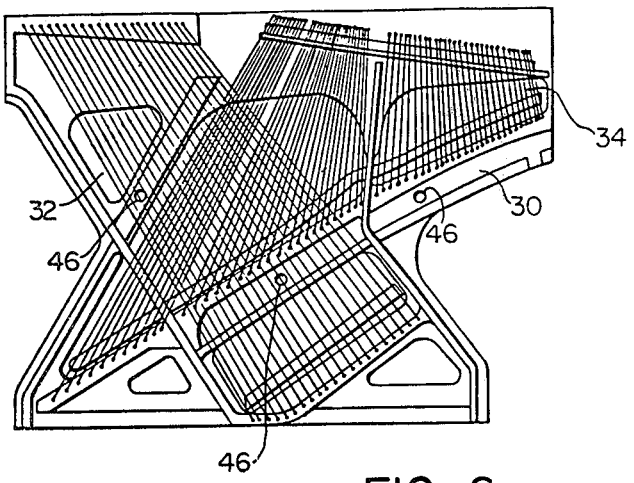
FIG. 6 is a front view of the strings and plate supported by the back frame in the piano.

The back frame 20 is a major structural part of the piano frame or case, and for this reason the frame 20 frequently includes handles 26 for lifting and moving the piano. A principal function of the frame 20 is support and reinforcement for the string plate 30 shown in FIG. 6 over which the plurality of bass strings 32 and treble strings 34 are stretched generally between the top and bottom of the plate. It will be understood that with a large number of tensioned strings, the resultant string load may reach several tons, and in order to achieve and maintain proper tuning and regulation of the piano, the plate must be held rigidly and maintain its positioning within the piano without distortion or creep. Because of the large string load, the heavy posts 22 and blocks in FIG. 2 are made from hardwoods and are bonded and bolted to the wrest plank which in turn is securely bolted to the plate within the piano. It will be observed in FIG. 6 that the long bass strings 32 extend at an angle to the shorter treble strings 34, but the resulting load from both sets of strings 32 and 34 is generally directed between the top and bottom of the plate. For this reason, the posts 22 in FIG. 2 are positioned vertically and carry the string load in a beam bending mode.

The beams 22 are spaced across the back frame and define large openings which expose the sounding board 40 and its reinforcing ribs 42. The side of the sounding board opposite the ribs carries a set of bridges over which the strings extend and, consequently, the openings between the posts 22 can emit a substantial portion of the musical sounds produced when the piano is played, although the sounds also emanate through other parts of the case.

Figure 3:
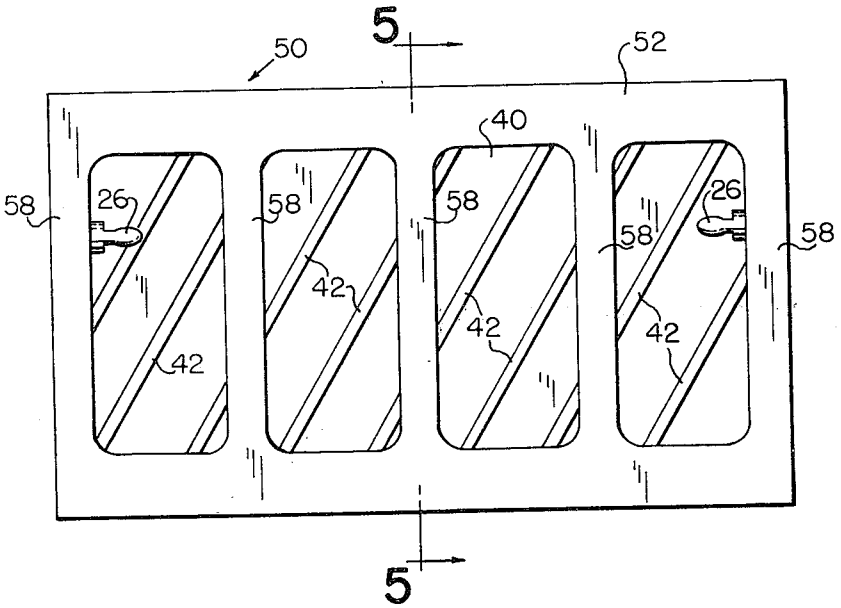
FIG. 3 is a rear view of the piano in FIG. 1 and shows the back frame of the present invention.

FIG. 3 shows the novel back frame 50 of the present invention that replaces the prior art back frame 20 in FIG. 2. The frame 50 has a rectangular geometric form corresponding to the rear of the piano 10 and is positioned behind the sounding board 40 in the same manner as the prior art frame 20. The frame 50 is also a part of the structural case of the piano to which the handles 26 at the rear are connected, and supports the string plate 30 (FIG. 6) within the piano case.

Figure 4:
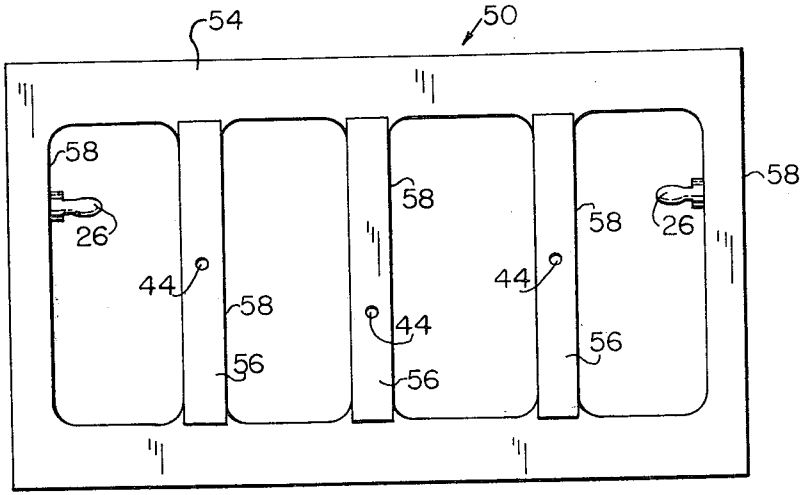
FIG. 4 is a front view of the back frame shown in FIG. 3.
Figure 5:
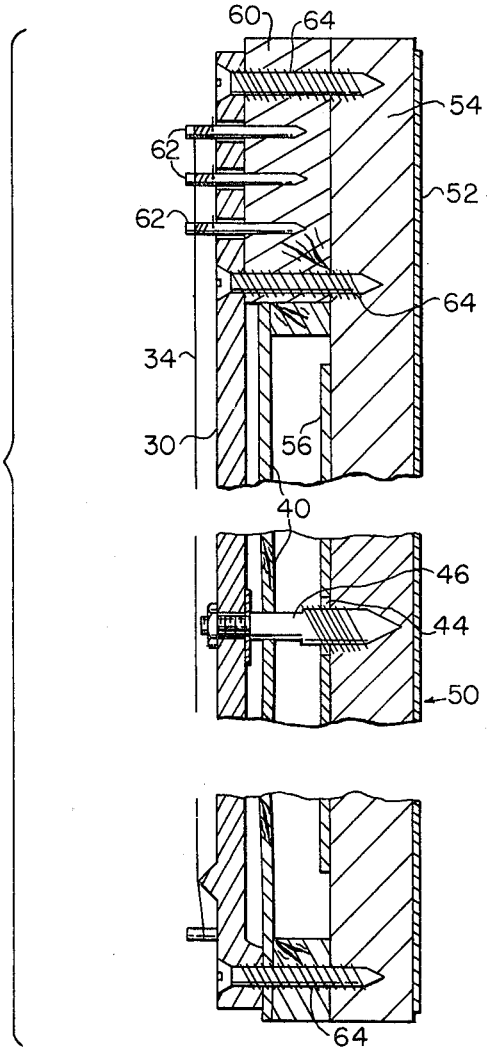
FIG. 5 is a transverse sectional view through the frame assembly at the rear of the piano along line 5—5 in FIG. 3 with portions broken away and shows the laminates of the back frame and the connection of the back frame to the wrest plank and plate supporting the tensioned strings of the piano.

As shown more clearly in FIGS. 4 and 5, the frame 50 is a laminated composite structure that includes an outer rear laminate 52 of a sheet metal, which defines the rear surface of the structure, and a thicker base laminate 54 joined with the metal laminate 52 and holding the metal laminate in spaced relationship from the string plate 30 within the piano case. In a preferred embodiment, the composite structure includes a further laminate covering less than the entire front surface of the structure. Such laminate takes the form of a plurality of sheet metal strips 56 that overlie respectively a plurality of integral beams 58 extending between the top and bottom of the frame 50. The beams 58 are spaced generally equally across the frame and define a plurality of openings between the front and rear surfaces of the frame for sound emission. The sheet metal strips 56 in the embodiment of FIG. 4 only overlie the three central beams, however, in other embodiments of the back frame, the strips may overlie some or all of the beams including the two beams 58 at each side of the back frame 50. The three central beams 58 provide direct support to the plate 30 by means of three shoulder bolts 46 which as shown in FIGS. 4 and 5 are bolted at one end to the plate 30 and pass through open holes in the sound board 40 and which are attached at the other end at typical positions 44 to the central beams 58. The strips 56 may also be integral parts of a one-piece laminate that covers the entire front surface of the frame in the same manner as the laminate 52 at the rear surface.

The illustrated embodiment utilizing the individual strips 56 allows other parts of the piano case to be joined or glued directly to the base laminate 54 without special adhesives or connections with the sheet metal. For example, as shown in FIG. 5, the wrest plank 60 supports the rotatable tuning pins 62 projecting through the top of the plate 30 and the strings 32 and 34, and is joined directly to the base laminate 54. The entire assembly including the plate 30 is held together by screws 64, bolts, and bonding.

In one embodiment of the back frame 50, the sheet metal strips 52 are made from steel and the base laminate 54 is made from a reconstituted wood product such as particleboard or fiberboard. The reconstituted products are comprised of wood that has been reduced to small pieces or fibers which are then reassembled in a panel by various manufacturing processes. Particleboard consists of small pieces of wood that have been reassembled with synthetic or other suitable binders while fiberboard is comprised of interfelted fibers derived from the basic wood product. For a more complete description of such reconstituted products, reference may be had to Agricultural Handbook No. 72 by the Forest Products Laboratory, Forest Service, U.S. Department of Agriculture and entitled Wood Handbook: Wood as an engineering material, Rev. August 1974.

The sheet metal laminates 52 and 56 are bonded directly to the base laminate 54 by a suitable bonding agent such as epoxy or acrylic resin. The bonding process takes place with pressure applied normal to the laminates and at temperatures suitable for curing the particular resin being used. The laminated structure is coated with a sealer where the base laminate 54 is exposed to prevent moisture from penetrating into the base laminate and causing frame distortion.

The primary functions of the base laminate 54 are to hold the sheet metal laminate 52 in structurally spaced relationship from the string plate 30 and also from the laminate formed by the metal strips 56 for frame stiffness or resistance to creep and deformation. For this reason the base laminate is substantially thicker than either of the metal laminates and it should be understood that more than one base material may be interposed between the strips 56 and the laminate 52. In one embodiment, the sheet metal laminates 52 and 56 have a thickness of 0.032 inch and the spacing between the metal laminates is established by a base laminate of fiberboard having thickness of 1.5 inches. The positioning of the metal laminates on the outside of the frame 50 relies upon the relatively high value of Young's modulus for the metal to add stiffness to the frame. The base laminate may have a relatively low modulus but by holding the sheet metal laminates in spaced relationship and spaced from the string plate 30, the metal is remote from the neutral bending axis of the frame under load from the strings 32 and 34. For example, steel has a Young's modulus of $30\times10^6$ psi which is relatively high compared to the modulus of $0.5\times10^6$ psi for fiberboard, and therefore, the sheet steel laminate 52 adds a significant degree of rigidity to the back frame 50 when positioned remotely from the bending axis and on the rear surface of the base laminate 54. The greater rigidity of the frame 50 combined with the strength of the metal string plate 30 renders the entire frame assembly in FIG. 5 readily adapted to support the large load of the strings 32 and 34 without warpage or creep over extended periods of time. As a consequence, the strings retain their tuning and hold their positioning relative to the hammers and sounding board of the instrument.

The laminated frame 50 can be economically manufactured from materials which are readily available. Steel sheet metal is a common commodity available in various thicknesses to control the degree of stiffness required by a piano of particular size. Reconstituted wood products such as particleboard are well known construction materials available from many local sources. The assembly of the metal and wood products in a laminated structure is carried out with conventional bonding agents, and no requirements for special treating equipment are imposed. The laminated frame with sheet metal on a large portion of the exterior surface is more resistant to moisture-induced distortion than the hardwood frames of the prior art due to the insensitivity of the sheet metal to moisture. The sides of the base laminate which are not covered by metal are closed to moisture with conventional sealers to provide moisture-proofing as needed. The laminated structure provides a totally integrated unit that can withstand loads without having major load carrying components separate at an aging or loosened joint.

Figure 7:
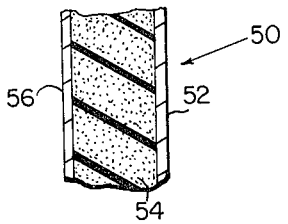
FIGS. 7 and 8 are fragmentary sectional views showing alternate embodiments of the back frame.
Figure 8:
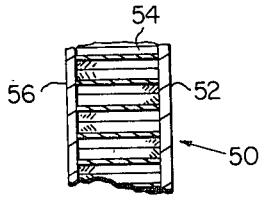

While the present invention has been described in a preferred embodiment it should be understood that numerous modifications and substitutions can be had without departing from the spirit of the invention. For example, the metal strips 56 on the inside surfaces of the beams 58 add increased rigidity to the beam portions of the frame and cooperate with the metal laminate 52 on the back surface, but even greater rigidity can be obtained with a full metal laminate on the front surface of the frame including each of the beams at the sides of the frame. Metals other than steel may be employed for the outer laminates but steel is preferred due to the high Young's modulus and ready availability. The material forming the base laminate 54 may be made from materials other than reconstituted wood products. Other acceptable materials include rigid foams such as a polyurethane foam used in furniture manufacture and shown in the embodiment of FIG. 7 or lightweight core materials such as paper or metal honeycombs shown in the embodiment of FIG. 8. Also, different sections of the base laminate may be composed of individual pieces of wood, foam and other core materials, and several sub-laminates may be assembled in side-by-side relationship to achieve a laminate of desired thickness. The geometric configuration of the frame shown in the drawings with a plurality of evenly spaced beams separating rectangular openings through the frame follows the traditional shape of the back frame, but the flexibility of cutting, molding or shaping the laminate material allows a great variety of geometric shapes including integral beams to be selected. Accordingly, the present invention has been described in a preferred embodiment by way of illustration rather than limitation.

What is claimed is:

1. A back frame of integrated design supporting the tensioned strings in a piano or like instrument comprising a laminated composite structure of geometric form corresponding to the back of the instrument and having generally parallel front and rear surfaces with openings for sound through the structure from one of said surfaces to the other and a plurality of integral beams extending between one side and another of the geometric form, the laminated structure including an outer rear laminate of metal defining the rear surface of the structure, a base laminate integrally bonded to the rear metal laminate and holding the metal laminate in spaced relationship from the strings to support the strings under load and an outer front laminate of metal at the front surface of the structure, the front laminate being integrally bonded to the base laminate and held by the base laminate in spaced and generally parallel relationship with the outer rear laminate of metal for frame stiffness and rigidity.

2. A back frame in a piano or like instrument as defined in claim 1 wherein the front laminate of metal bonded to the front surface of the base laminate overlies less than the entire front surface of the base laminate.

3. A back frame in a piano or like instrument as described in claim 1 wherein the outer front laminate of metal is comprised by a plurality of metal strips overlying a corresponding plurality of the integral beams respectively at the front surface of the laminated structure, each strip being bonded to the base laminate in generally spaced and parallel relationship with the outer rear laminate for increased beam stiffness and rigidity.

4. A back frame in a piano or like instrument as defined in claim 1 wherein the base laminate is formed by a material having a Young's modulus substantially less than the modulus of the metal in the outer laminate.

5. A back frame in a piano or like instrument as defined in claim 1 or 3 or 4 wherein the metal laminates are sheet metal laminates bonded to the base laminate.

6. A back frame in a piano or like instrument as defined in claim 1 or 3 wherein the metal is sheet steel.

7. A back frame in a piano or like instrument as defined in claim 1 or 3 wherein the base laminate has a thickness substantially greater than the thickness of the metal.

8. A back frame as in claim 1 wherein the material forming the base laminate is a reconstituted wood product.

9. A back frame as in claim 1 wherein the material forming the base laminate is a rigid foam.

10. A back frame as in claim 1 wherein the material forming the base laminate is a honeycomb core material.

11. In a piano, harpsichord or like musical instrument, a back frame supporting and reinforcing the components holding the tension load of the strings which are struck or plucked to produce musical sounds comprising: a laminated composite structure located at one side of the instrument and having two oppositely disposed surfaces extending generally parallel to each other and to the tension load of the strings, the laminated structure including a plurality of laminates between the oppositely disposed surfaces, the laminates being bonded together in an integral design, the outer laminates of the structure being sheet metal laminates and another of the laminates between the outer laminates having a thickness greater than the thickness of the outer sheet metal laminates and a Young's modulus substantially less than the modulus of the sheet metal whereby the high modulus of the outer sheet metal laminates and the greater thickness of the other laminate between the outer laminates cooperate in the integral design to rigidize the back frame against movement or deflection under the tension load of the strings.

12. An assembly supporting the strings in a piano or like instrument comprising:

a plate defining a framework over which the strings are stretched from one side to another;

a wrest plank positioned adjacent the plate at one side and a plurality of rotatable tuning pins mounted in the wrest plank and projecting through the plate from the plank for attachment and tensioning the strings stretched over the plate;

a laminated structure forming an integrated structural support for the plate in the instrument and connected with the plate at said one side through the wrest plank and with the other side for resisting bending of the plate under the load of the tensioned strings, the laminated structure including a base laminate extending generally parallel with the plate and two outer laminates integrally joined respectively to oppositely disposed sides of the base laminate, the two outer laminates being sheet metal and the base laminate being substantially thicker than the sheet metal and holding the outer laminates in spaced relationship to rigidly resist movement and bending of the plate under the load of the tensioned strings.

13. An assembly supporting the strings in a piano or like instrument as defined in claim 12 wherein the outer laminate of sheet metal on the side of the base laminate adjacent the plate, overlies a limited portion of the adjacent side.

14. An assembly supporting the strings as defined in claim 13 wherein the base laminate of the integrated structural support for the plate is connected to the wrest plank at a portion of said adjacent side other than the limited portion which the sheet metal laminate overlies.

15. An assembly supporting the strings as defined in claim 13 wherein the laminated structure includes a plurality of integral beam elements extending generally in the same direction as the tensioning load of the strings over the plate, the beam elements being spaced from one another and defining openings through each of the laminates of the structure for sound emission.

* * * * *